US012788132B2

(12) United States Patent
Su

(10) Patent No.: US 12,788,132 B2
(45) Date of Patent: Nov. 10, 2026

(54) CLEANING DEVICE

(71) Applicant: Hong Ann Tool Industries Co., Ltd., Taichung City (TW)

(72) Inventor: Cheng-Wei Su, Taichung City (TW)

(73) Assignee: Hong Ann Tool Industries Co., Ltd., Taichung City (TW)

( * ) Notice: Subject to any disclaimer, the term of this patent is extended or adjusted under 35 U.S.C. 154(b) by 318 days.

(21) Appl. No.: 18/624,581

(22) Filed: Apr. 2, 2024

(65) Prior Publication Data

US 2024/0415272 A1 Dec. 19, 2024

(30) Foreign Application Priority Data

Jun. 16, 2023 (TW) ..... 112122630

(51) Int. Cl.
*A46B 5/00* (2006.01)
*A46B 13/00* (2006.01)
*A46B 13/02* (2006.01)

(52) U.S. Cl.
CPC ..... *A46B 5/002* (2013.01); *A46B 5/0095* (2013.01); *A46B 13/001* (2013.01); *A46B 13/02* (2013.01); *A46B 2200/30* (2013.01)

(58) Field of Classification Search
CPC ... B24B 27/003; A46B 5/0095; A46B 13/001; B08B 9/021; B08B 9/023
See application file for complete search history.

(56) References Cited

U.S. PATENT DOCUMENTS

| | | | | |
|---|---|---|---|---|
| 5,933,918 | A | 8/1999 | Wallays | |
| 7,465,942 | B2 | 12/2008 | Nguyen et al. | |
| 8,032,970 | B2 * | 10/2011 | Chen | A46B 13/001 15/160 |
| 2004/0226576 | A1 * | 11/2004 | Hambalek | B08B 1/36 15/23 |
| 2017/0273449 | A1 * | 9/2017 | Lin | B08B 9/021 |

FOREIGN PATENT DOCUMENTS

| | | | |
|---|---|---|---|
| CN | 201046095 | Y | 4/2008 |
| CN | 210697444 | U | 6/2020 |
| CN | 112674642 | A | 4/2021 |
| CN | 216779547 | U | 6/2022 |
| CN | 218165163 | U | 12/2022 |
| CN | 116250771 | A | 6/2023 |
| TW | 325400 | B | 1/1998 |

* cited by examiner

*Primary Examiner* — Shay Karls
(74) *Attorney, Agent, or Firm* — MUNCY, GEISSLER, OLDS & LOWE, P.C.

(57) ABSTRACT

A cleaning device includes a connecting member, a brushing assembly, and a limiting member. The connecting member has a driving end, a driven end adapted for connecting to a power tool, and a driving hole extending from the driving end towards the driven end. The inner surface of the driving hole is provided with a first limiting slot. The brushing assembly includes a holding member detachably connected to the driving hole and a brushing member mounted on the holding member. The outer surface of the holding member is provided with a second limiting slot corresponding to the first limiting slot, and the brushing member has a rough surface. The limiting member is detachably engaged into the first limiting slot and the second limiting slot.

9 Claims, 3 Drawing Sheets

CLEANING DEVICE

BACKGROUND OF THE INVENTION

The present invention relates to a cleaning device and, more particularly, to a cleaning device for cleaning the surfaces of tools or parts.

Parts of tools or equipment, when used over a long period, may have issues such as surface rust, rust spots, or accumulated dirt. Most tools or parts can still be used after their surfaces have been cleaned, which avoids the need for replacement. However, traditional cleaning methods involve manually scraping off rust and dirt with tools like screwdrivers or knives, or sanding the surface with abrasive cloth. These methods are not only inefficient but also often result in poor cleaning outcomes and can easily scratch the surface.

Thus, a need exists for a cleaning device to mitigate and/or obviate the above disadvantages.

SUMMARY OF THE INVENTION

In general, this disclosure describes a cleaning device that includes a connecting member, a brushing assembly, and a limiting member. The connecting member has a driving end, a driven end adapted for connecting to a power tool, and a driving hole extending from the driving end towards the driven end. An inner surface of the driving hole is provided with at least one first limiting slot. The brushing assembly includes a holding member detachably connected to the driving hole and a brushing member mounted on the holding member. An outer surface of the holding member is provided with a second limiting slot corresponding to the at least one first limiting slot. The brushing member has a rough surface. The limiting member is detachably engaged into the at least one first limiting slot and the second limiting slot.

In one example, the driving hole is a polygonal hole. The inner surface of the driving hole is further provided with a plurality of driving surfaces. The number of the at least one first limiting slot is plural. The plurality of first limiting slots are respectively formed on the plurality of driving surfaces.

In one example, each pair of adjacent driving surfaces has a rounded corner.

In one example, the holding member has a head and a body connected to the head. The brushing member is mounted on the head. The second limiting slot is formed on an outer surface of the body.

In one example, the body has a polygonal cross section corresponding to the driving hole, allowing the body to be detachably inserted into the driving hole.

In one example, the holding member further includes a containing recess located in the head. The brushing member has a circular cross section and includes a large diameter portion, a small diameter portion connected to the large diameter portion, and a through hole penetrating opposite sides of the brushing member. The rough surface is at least formed on a surface of the large diameter portion. The small diameter portion is accommodated and connected within the containing recess.

In one example, the limiting member is annular and has an opening being expandable or retractable.

In one example, the connecting member further has a driven hole located at the driven end and communicated to the driving hole. The driven hole is adapted for detachably connecting to the power tool.

In one example, the driven hole is a square hole.

In one example, the connecting member further has an annular groove located on an outer surface of the driven end.

The present invention will become clearer in light of the following detailed description of illustrative embodiments of this invention described in connection with the drawings.

DETAILED DESCRIPTION OF THE INVENTION

Figure 1:
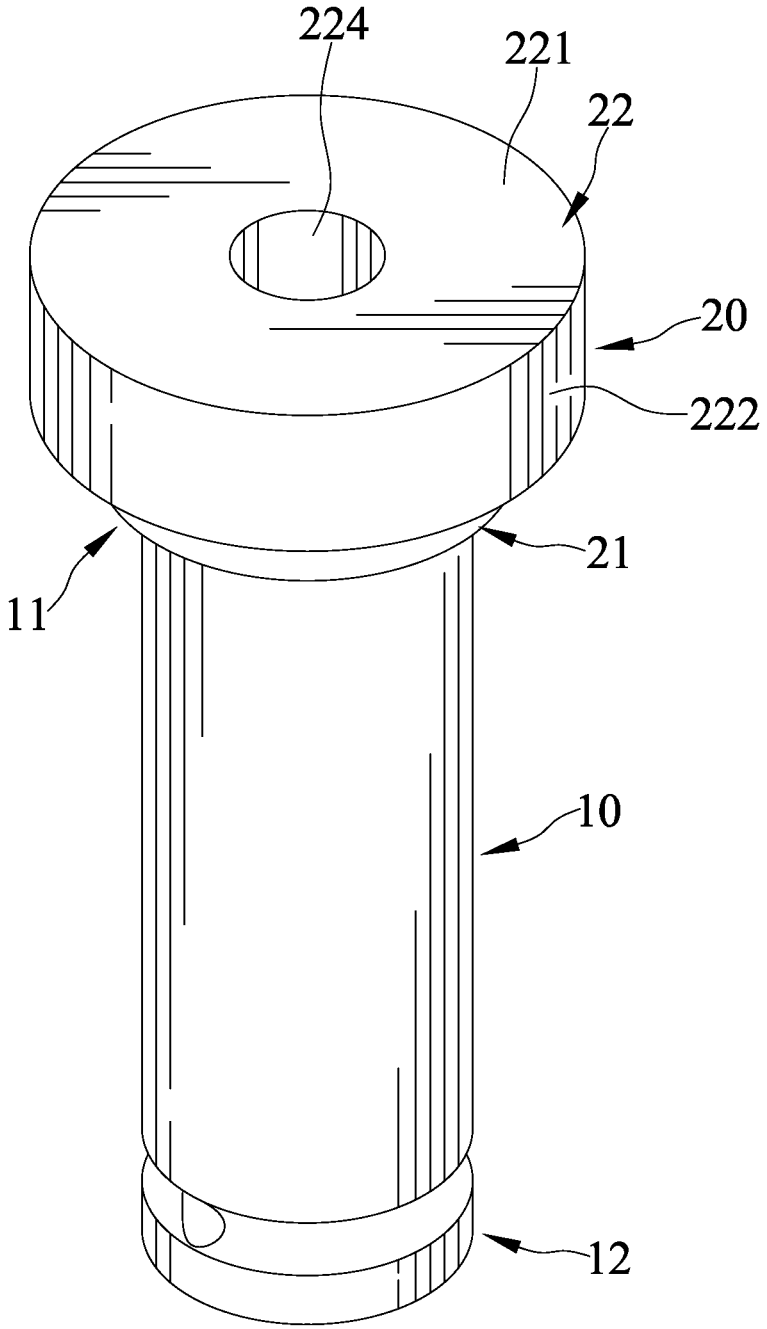
FIG. 1 is a perspective view of a cleaning device of an embodiment according to the present invention.
Figure 2:
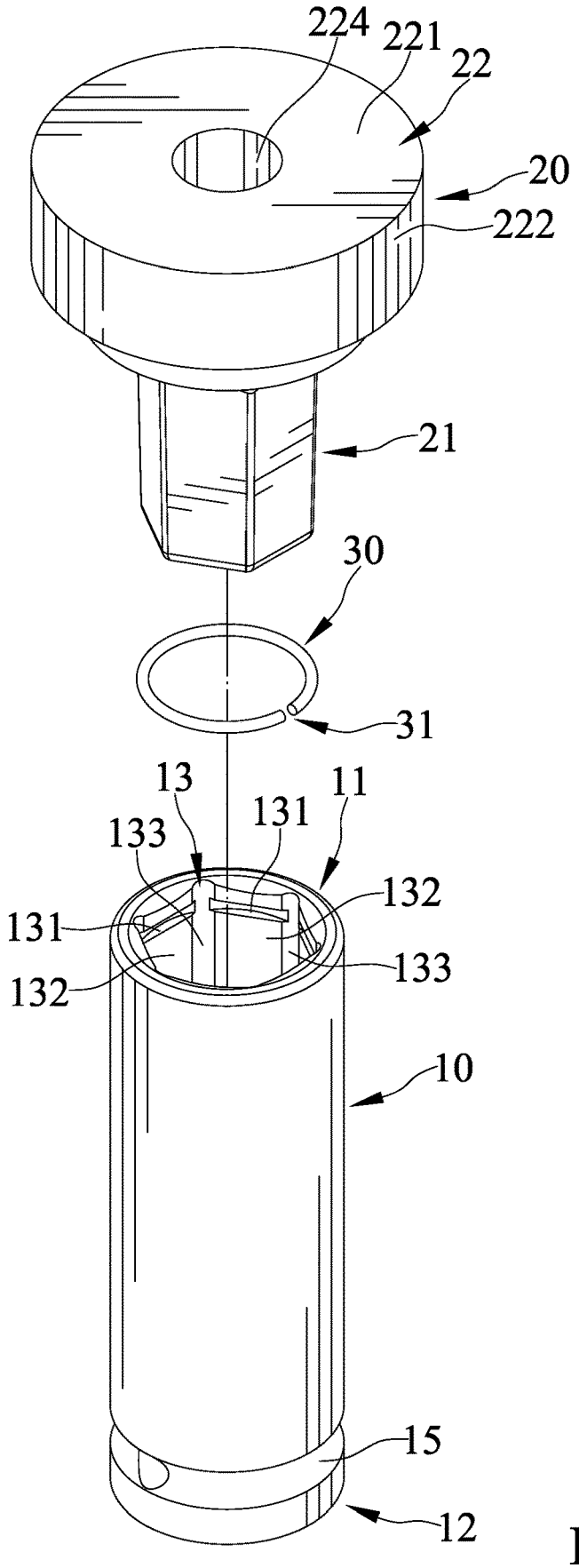
FIG. 2 is an exploded perspective view of the cleaning device of FIG. 1.
Figure 3:
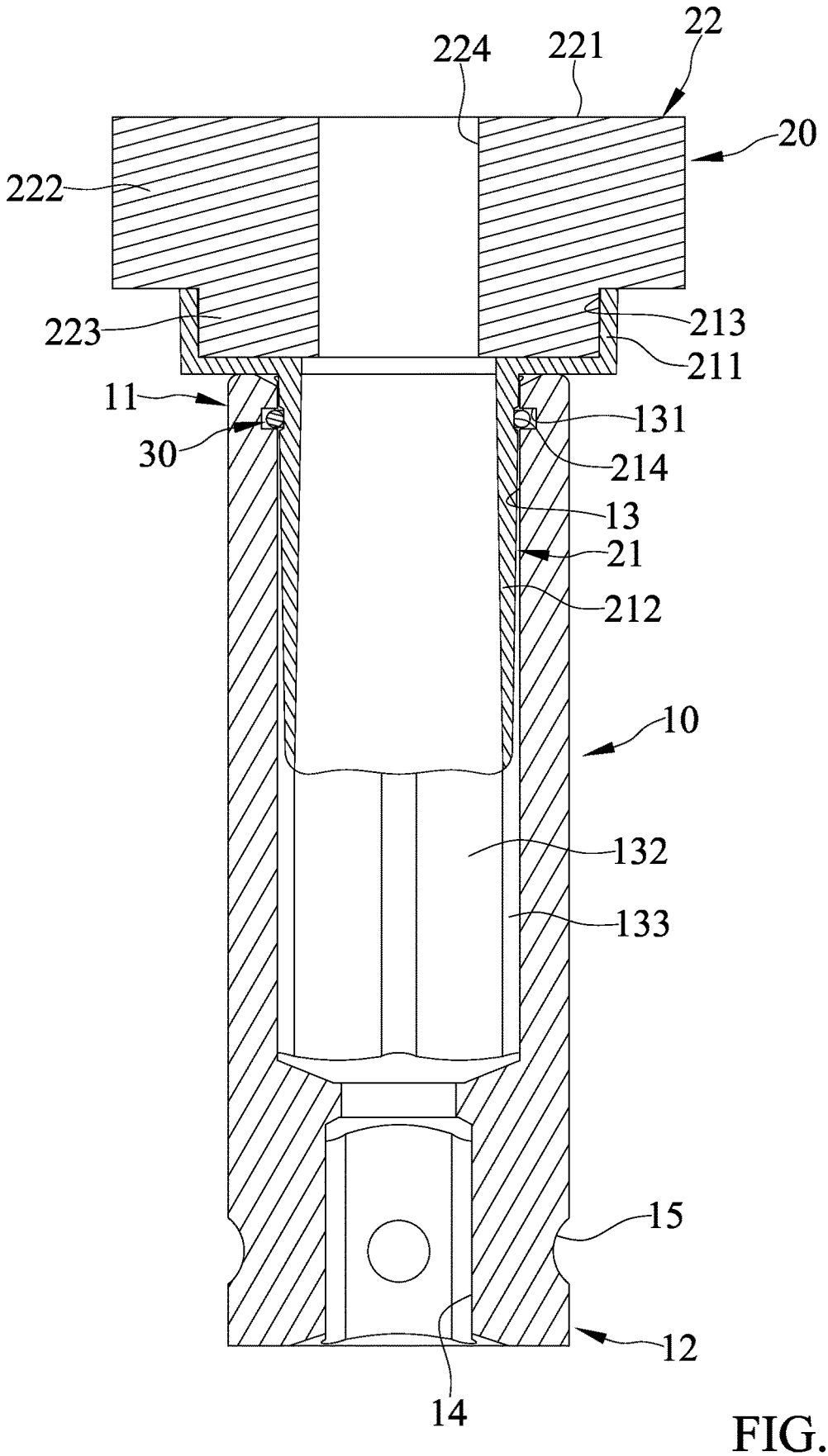
FIG. 3 is a cross sectional view of the cleaning device of FIG. 1.

FIGS. 1-3 show a cleaning device of an embodiment according to the present invention. The cleaning device includes a connecting member 10, a brushing assembly 20, and a limiting member 30.

The connecting member 10 has a driving end 11, a driven end 12 adapted for connecting to a power tool, and a driving hole 13 extending from the driving end 11 towards the driven end 12. An inner surface of the driving hole 13 is provided with at least one first limiting slot 131. In the embodiment, the driving hole 13 may be a polygonal hole. The inner surface of the driving hole 13 is further provided with a plurality of driving surfaces 132. The number of the at least one first limiting slot 131 in the embodiment is plural, and the plurality of first limiting slots 131 are respectively formed on the plurality of driving surfaces 132. Further, each pair of adjacent driving surfaces 132 has a rounded corner 133. The connecting member 10 further has a driven hole 14 located at the driven end 12 and communicated to the driving hole 13. The driven hole 14 is adapted for detachably connecting to the power tool, allowing the connecting member 10 to be driven to rotate by the power tool. In addition, the driven hole 14 may be a square hole, and the connecting member 10 further has an annular groove 15 located on an outer surface of the driven end 12. The annular groove 15 can be engaged with a retaining ring to ensure that the connecting member 10 does not accidentally fall off from the power tool during use.

The brushing assembly 20 includes a holding member 21 detachably connected to the driving hole 13 and a brushing member 22 mounted on the holding member 21. An outer surface of the holding member 21 is provided with a second limiting slot 214 corresponding to the first limiting slots 131. The brushing member 22 has a rough surface 221. Further, the holding member 21 has a head 211 and a body 212 connected to the head 211. The brushing member 22 is mounted on the head 211. The second limiting slot 214 is formed on an outer surface of the body 212. In the embodiment, the body 212 may have a polygonal cross section corresponding to the driving hole 13, allowing the body 212 to be detachably inserted into the driving hole 13. In addition, the holding member 21 further includes a containing recess 213 located in the head 211. The brushing member 22 has a circular cross section and includes a large diameter portion 222, a small diameter portion 223 connected to the large diameter portion 222, and a through hole 224 penetrating opposite sides of the brushing member 22. In the embodiment, the rough surface 221 may be at least formed on an end surface and a periphery surface of the large diameter portion 222. The small diameter portion 223 is accommodated and connected within the containing recess 213. allowing the brushing member 22 mounted on the head 211. The through hole 224 is adapted to accommodate tools or parts to be cleaned, such as bolts or nuts, cleaning their periphery by an inner surface of the through hole 224.

The limiting member 30 is detachably engaged into the first limiting slots 131 and the second limiting slot 214, allowing the brushing assembly 20 to be selectively connected to or detached from the connecting member 10, thereby facilitating the replacement of different brushing assemblies 20. In the embodiment, the limiting member 30 may be annular and has an has an opening 31 being expandable or retractable, meaning that the limiting member 30 may be a C-shaped retaining ring that can be driven by tools such as retaining ring pliers to selectively detach from the second limiting slot 214, allowing the body 212 of the holding member 21 to be detached from the driving hole 13 of the connecting member 10 for the replacement of the brushing assembly 20.

In summary, in the embodiment, the driven end 12 of the connecting member 10 is adapted for connecting to the power tool, allowing the connecting member 10 to be driven by the power tool to rotate synchronously with the brushing assembly 20 for cleaning the surface of tools or parts. Moreover, the limiting member 30 can be selectively detached from the second limiting groove 214, allowing the body 212 of the holding member 21 to be detached from the drive hole 13 of the connecting member 10 for the replacement of the brushing assembly 20.

Although specific embodiments have been illustrated and described, numerous modifications and variations are still possible without departing from the scope of the invention. The scope of the invention is limited by the accompanying claims.

The invention claimed is:

1. A cleaning device comprising:

a connecting member having a driving end, a driven end adapted for connecting to a power tool, and a driving hole extending from the driving end towards the driven end, wherein the driving hole is a polygonal hole, wherein an inner surface of the driving hole is provided with a plurality of first limiting slots and a plurality of driving surfaces, and wherein the plurality of first limiting slots are respectively formed on the plurality of driving surfaces;

a brushing assembly including a holding member detachably connected to the driving hole and a brushing member mounted on the holding member, wherein an outer surface of the holding member is provided with a second limiting slot corresponding to the at least one first limiting slot, and wherein the brushing member has a rough surface; and a limiting member detachably engaged into the at least one first limiting slot and the second limiting slot.

2. The cleaning device as claimed in claim 1, wherein each pair of adjacent driving surfaces has a rounded corner.

3. The cleaning device as claimed in claim 1, wherein the holding member has a head and a body connected to the head, wherein the brushing member is mounted on the head, and wherein the second limiting slot is formed on an outer surface of the body.

4. The cleaning device as claimed in claim 3, wherein the body has a polygonal cross section corresponding to the driving hole, allowing the body to be detachably inserted into the driving hole.

5. The cleaning device as claimed in claim 3, wherein the holding member further includes a containing recess located in the head, wherein the brushing member has a circular cross section and includes a large diameter portion, a small diameter portion connected to the large diameter portion, and a through hole penetrating opposite sides of the brushing member, wherein the rough surface is at least formed on a surface of the large diameter portion, and wherein the small diameter portion is accommodated and connected within the containing recess.

6. The cleaning device as claimed in claim 1, wherein the limiting member is annular and has an opening being expandable or retractable.

7. The cleaning device as claimed in claim 1, wherein the connecting member further has a driven hole located at the driven end and communicated to the driving hole, and wherein the driven hole is adapted for detachably connecting to the power tool.

8. The cleaning device as claimed in claim 7, wherein the driven hole is a square hole.

9. The cleaning device as claimed in claim 1, wherein the connecting member further has an annular groove located on an outer surface of the driven end.

* * * * *